US011532267B2

(12) United States Patent
Feng et al.

(10) Patent No.: US 11,532,267 B2
(45) Date of Patent: Dec. 20, 2022

(54) PIXEL DRIVING CIRCUIT WITH LIGHT-EMITTING CONTROL SUB-CIRCUIT AND DISPLAY CONTROL SUB-CIRCUIT AND DRIVING METHOD THEREFOR, DISPLAY PANEL AND DISPLAY APPARATUS

(71) Applicants: Hefei BOE Joint Technology Co., Ltd., Anhui (CN); BOE TECHNOLOGY GROUP CO., LTD., Beijing (CN)

(72) Inventors: Xuehuan Feng, Beijing (CN); Zheng Liu, Beijing (CN)

(73) Assignees: Hefei BOE Joint Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/419,205

(22) PCT Filed: Sep. 21, 2020

(86) PCT No.: PCT/CN2020/116482
§ 371 (c)(1),
(2) Date: Jun. 28, 2021

(87) PCT Pub. No.: WO2021/057653
PCT Pub. Date: Apr. 1, 2021

(65) Prior Publication Data

US 2022/0076622 A1 Mar. 10, 2022

(30) Foreign Application Priority Data

Sep. 29, 2019 (CN) ..... 201910940936.5

(51) Int. Cl.
*G09G 3/3208* (2016.01)

(52) U.S. Cl.
CPC ... *G09G 3/3208* (2013.01); *G09G 2300/0809* (2013.01); *G09G 2310/061* (2013.01); *G09G 2310/08* (2013.01)

(58) Field of Classification Search
CPC ..... G09G 3/3208
See application file for complete search history.

(56) References Cited

U.S. PATENT DOCUMENTS

2008/0074363 A1* 3/2008 Yamashita ..... G09G 3/3233 345/80
2014/0009456 A1* 1/2014 Kim ..... G09G 3/3208 345/82

(Continued)

FOREIGN PATENT DOCUMENTS

CN 103886836 A 6/2014
CN 104036724 A 9/2014

(Continued)

OTHER PUBLICATIONS

First Office Action of Priority Application No. CN 201910940936.5 issued by the Chinese Patent Office dated Aug. 4, 2020.

(Continued)

*Primary Examiner* — William Boddie
*Assistant Examiner* — Andrew B Schnirel
(74) *Attorney, Agent, or Firm* — IP & T Group LLP

(57) ABSTRACT

A pixel driving circuit includes a light-emitting control sub-circuit and a plurality of display control sub-circuits. The light-emitting control sub-circuit is connected to a light-emitting control signal terminal, a power supply signal terminal and a light-emitting control node, and is configured to transmit a power supply signal from the power supply signal terminal to the light-emitting control node in response to a light-emitting control signal received from the light-emitting control signal terminal. Each display control sub-circuit is connected to the light-emitting control node, a scan (Continued)

signal terminal, a data signal terminal, and a light-emitting element. Each display control sub-circuit is configured to, in response to a scan signal received from the scan signal terminal, output a driving signal according to the power supply signal and a data signal from the data signal terminal, so as to drive the light-emitting element to emit light.

4 Claims, 10 Drawing Sheets

(56) References Cited

U.S. PATENT DOCUMENTS

| | | | | |
|---|---|---|---|---|
| 2014/0353608 | A1* | 12/2014 | Kim | G09G 3/3233 257/40 |
| 2015/0187272 | A1 | 7/2015 | Kimura et al. | |
| 2015/0200239 | A1* | 7/2015 | Jung | H01L 27/3258 257/40 |
| 2016/0125798 | A1* | 5/2016 | Park | G09G 3/3208 345/204 |
| 2016/0284274 | A1 | 9/2016 | Tan et al. | |
| 2016/0300532 | A1 | 10/2016 | Tan et al. | |
| 2016/0322450 | A1* | 11/2016 | Lee | H01L 27/3262 |
| 2016/0365031 | A1 | 12/2016 | Wu et al. | |
| 2016/0365032 | A1 | 12/2016 | Wu et al. | |
| 2017/0221419 | A1 | 8/2017 | Xiang et al. | |
| 2017/0365214 | A1* | 12/2017 | Tsai | G09G 3/3233 |
| 2018/0137817 | A1 | 5/2018 | Wu et al. | |
| 2020/0286432 | A1* | 9/2020 | Zhang | G09G 3/3258 |
| 2021/0358411 | A1 | 11/2021 | Wen et al. | |

FOREIGN PATENT DOCUMENTS

| | | | |
|---|---|---|---|
| CN | 104123912 | A | 10/2014 |
| CN | 104157238 | A | 11/2014 |
| CN | 104157239 | A | 11/2014 |
| CN | 104575379 | A | 4/2015 |
| CN | 105489158 | A | 4/2016 |
| CN | 105761674 | A | 7/2016 |
| CN | 106531084 | A | 3/2017 |
| CN | 106782301 | A | 5/2017 |
| CN | 107170408 | A | 9/2017 |
| CN | 108682366 | A | 10/2018 |
| CN | 109300436 | A | 2/2019 |
| CN | 110660359 | A | 1/2020 |
| KR | 10-2009-0054321 | A | 5/2009 |

OTHER PUBLICATIONS

The Second Office Action of Priority Application No. CN 201910940936.5 issued by the Chinese Patent Office dated Mar. 3, 2021.

The Third Office Action of Priority Application No. CN 201910940936.5 issued by the Chinese Patent Office dated Aug. 4, 2021.

* cited by examiner

PIXEL DRIVING CIRCUIT WITH LIGHT-EMITTING CONTROL SUB-CIRCUIT AND DISPLAY CONTROL SUB-CIRCUIT AND DRIVING METHOD THEREFOR, DISPLAY PANEL AND DISPLAY APPARATUS

CROSS-REFERENCE TO RELATED APPLICATIONS

This application is a national phase entry under 35 USC 371 of International Patent Application No. PCT/CN2020/116482, filed on Sep. 21, 2020, which claims priority to Chinese Patent Application No. 201910940936.5, filed on Sep. 29, 2019, which are incorporated herein by reference in their entirety.

TECHNICAL FIELD

The present disclosure relates to the field of display technologies, and in particular, to a driving circuit and a driving method therefor, a display panel and a display apparatus.

BACKGROUND

With the development of display technologies, requirements for the quality of a display screen are getting higher and higher. At present, an organic light-emitting diode (OLED) display device is widely used due to the advantages of high brightness, high contrast, low power consumption, and wide viewing angle. However, deviations of characteristics of driving transistors in an OLED pixel circuit result in non-uniformity in display brightness. In order to overcome this problem, a pixel driving circuit is usually required to have a complicated circuit configuration.

SUMMARY

According to an aspect of embodiments of the present disclosure, a pixel driving circuit is provided. The pixel driving circuit includes a light-emitting control sub-circuit and a plurality of display control sub-circuits. The light-emitting control sub-circuit is connected to a light-emitting control signal terminal, a power supply signal terminal and a light-emitting control node. The light-emitting control sub-circuit is configured to transmit a power supply signal from the power supply signal terminal to the light-emitting control node in response to a light-emitting control signal received from the light-emitting control signal terminal. Each display control sub-circuit is connected to the light-emitting control node, a scan signal terminal, a data signal terminal, and a light-emitting element. The display control sub-circuit is configured to, in response to a scan signal received from the scan signal terminal, output a driving signal according to the power supply signal at the light-emitting control node and a data signal from the data signal terminal, so as to drive the light-emitting element to emit light.

In some embodiments, the light-emitting control sub-circuit includes a first transistor. A gate of the first transistor is connected to the light-emitting control terminal, a first electrode of the first transistor is connected to the power supply signal terminal, and a second electrode of the first transistor is connected to the light-emitting control node.

In some embodiments, the display control sub-circuit includes a first control sub-circuit and a first driving sub-circuit. The first control sub-circuit is connected to the scan signal terminal, the data signal terminal and the first driving sub-circuit. The first control sub-circuit is configured to transmit the data signal from the data signal terminal to the first driving sub-circuit in response to the scan signal received from the scan signal terminal. The first driving sub-circuit is further connected to the light-emitting control node and the light-emitting element. The first driving sub-circuit is configured to output the driving signal according to the power supply signal from the power supply signal terminal at the light-emitting control node and the data signal from the data signal terminal, so as to drive the light-emitting element to emit light.

In some embodiments, the first control sub-circuit includes a second transistor. The first driving sub-circuit includes a third transistor and a first capacitor, and the third transistor is a driving transistor. A gate of the second transistor is connected to the scan signal terminal, a first electrode of the first transistor is connected to the data signal terminal, and a second electrode of the first transistor is connected to a gate of the third transistor. A first electrode of the third transistor is connected to the light-emitting control node, a second electrode of the third transistor is connected to the light-emitting element. A first terminal of the first capacitor is connected to the gate of the third transistor, a second terminal of the first capacitor is connected to the second electrode of the third transistor, or the second terminal of the first capacitor is connected to the first electrode of the third transistor.

In some embodiments, the display control sub-circuit further includes a second control sub-circuit. The second control sub-circuit is connected to a first signal terminal, a second signal terminal and the second electrode of the third transistor. The second control sub-circuit is configured to, in response to a control signal received from the first signal terminal, transmit a reset signal from the second signal terminal to the second electrode of the third transistor, so as to reset the light-emitting element connected to the second electrode of the third transistor, and/or, output a parameter of the third transistor through the second signal terminal.

In some embodiments, the second control sub-circuit includes a fourth transistor. A gate of the fourth transistor is connected to the first signal terminal, a first electrode of the fourth transistor is connected to the second signal terminal, and a second electrode of the fourth transistor is connected to the second electrode of the third transistor.

In some embodiments, the first transistor, the second transistor, the third transistor, and the fourth transistor are N-type transistors, and the second terminal of the first capacitor is connected to the second electrode of the third transistor. Or the first transistor, the second transistor, the third transistor, and the fourth transistor are P-type transistors, and the second terminal of the first capacitor is connected to the first electrode of the third transistor.

In some embodiments, the display control sub-circuit includes a second driving sub-circuit, a writing sub-circuit, a first reset sub-circuit and a third control sub-circuit.

The second driving sub-circuit includes a fifth transistor and a second capacitor, and the fifth transistor is a driving transistor. A gate of the fifth transistor is connected to a first node, a first electrode of the fifth transistor is connected to the light-emitting control node, a second electrode of the fifth transistor is connected to a second node. A first terminal of the second capacitor is connected to the first node, and a second terminal of the second capacitor is connected to the power supply signal terminal.

The writing sub-circuit is connected to the scan signal terminal, the data signal terminal, the light-emitting control node, the first node and the second node. The writing sub-circuit is configured to, in response to the scan signal received from the scan signal terminal, transmit the data signal from the data signal terminal to the first node, and compensate for a threshold voltage of the fifth transistor.

The first reset sub-circuit is connected to a first reset control signal terminal, an initialization signal terminal and the first node. The first reset sub-circuit is configured to transmit an initialization signal from the initialization signal terminal to the first node in response to a first reset control signal received from the first reset control signal terminal.

The third control sub-circuit is connected to the light-emitting control signal terminal, the second node, and the light-emitting element. The third control sub-circuit is configured to electrically connect the light-emitting element to the second node in response to the light-emitting control signal received from the light-emitting control signal terminal.

In some embodiments, the writing sub-circuit includes a sixth transistor and a seventh transistor. A gate of the sixth transistor is connected to the scan signal terminal, a first electrode of the sixth transistor is connected to the data signal terminal, and a second electrode of the sixth transistor is connected to the light-emitting control node. A gate of the seventh transistor is connected to the scan signal terminal, a first electrode of the seventh transistor is connected to the second node, and a second electrode of the seventh transistor is connected to the first node. In some embodiments, the first reset sub-circuit includes an eighth transistor. A gate of the eighth transistor is connected to the first reset control signal terminal, a first electrode of the eighth transistor is connected to the initialization signal terminal, and a second electrode of the eighth transistor is connected to the first node. In some embodiments, the third control sub-circuit includes a ninth transistor. A gate of the ninth transistor is connected to the light-emitting control signal terminal, a first electrode of the ninth transistor is connected to the second node, and a second electrode of the ninth transistor is connected to an anode of the light-emitting element.

In some embodiments, the display control sub-circuit further includes a second reset sub-circuit. The second reset sub-circuit is connected to a second reset control signal terminal, the initialization signal terminal, and an anode of the light-emitting element. The second reset sub-circuit is configured to transmit the initialization signal from the initialization signal terminal to the anode of the light-emitting element in response to a second reset control signal received from the second reset control signal terminal.

In some embodiments, the second reset sub-circuit includes a tenth transistor. A gate of the tenth transistor is connected to the second reset control signal terminal, a first electrode of the tenth transistor is connected to the initialization signal terminal, and a second electrode of the tenth transistor is connected to the anode of the light-emitting element.

According to another aspect of the embodiments of the present disclosure, a display panel is provided. The display panel has a plurality of sub-pixel regions. The display panel includes a plurality of pixel driving circuits described above and a plurality of light-emitting elements. Each light-emitting element is connected to a corresponding display control sub-circuit, and the light-emitting element and the corresponding display control sub-circuit are located in a same sub-pixel region.

In some embodiments, light-emitting control signal terminals connected to light-emitting control sub-circuits located in sub-pixel regions in a same row are connected to one another. Scan signal terminals connected to display control sub-circuits located in sub-pixel regions in a same row are connected to one another. Data signal terminals connected to display control sub-circuits located in sub-pixel regions in a same column are connected to one another.

In some embodiments, the plurality of display control sub-circuits in each pixel driving circuit are located in respective sub-pixel regions in a same row.

In some embodiments, the plurality of display control sub-circuits include three display control sub-circuits, and the three display control sub-circuits include a first display control sub-circuit, a second display control sub-circuit, and a third display control sub-circuit. The plurality of light-emitting elements include first light-emitting elements that emit red light, second light-emitting elements that emit green light, and third light-emitting elements that emit blue light. The first display control sub-circuit is connected to one of the first light-emitting elements, the second display control sub-circuit is connected to one of the second light-emitting elements, and the third display control sub-circuit is connected to one of the third light-emitting elements.

According to yet another aspect of the embodiments of the present disclosure, a display apparatus is provided. The display apparatus includes the display panel described above.

According to yet another aspect of the embodiments of the present disclosure, a driving method of the pixel driving circuit is provided. The driving method includes:

in a first period, applying the data signal to the data signal terminal connected to the display control sub-circuit, and applying the scan signal to the scan signal terminal, so that the display control sub-circuit stores the data signal; and in a second period, applying the light-emitting control signal to the light-emitting control signal terminal connected to the light-emitting control sub-circuit, so that the light-emitting control sub-circuit transmits the power supply signal from the power supply signal terminal to the light-emitting control node, and the display control sub-circuit outputs the driving signal according to the stored data signal and the power supply signal at the light-emitting control node, so as to make the light-emitting element emit light.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method and an actual timing of a signal involved in the embodiments of the present disclosure.

DETAILED DESCRIPTION

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the terms such as "one embodiment", "some embodiments", "exemplary embodiments", "an example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

In the description of some embodiments, the term "connected" and derivatives thereof may be used. For example, the term "connected" may be used in the description of some embodiments to indicate that two or more components are in direct physical contact or electrical contact with each other.

In the circuits provided by the embodiments of the present disclosure, a first node, a second node, and a light-emitting control node do not represent actual components, but represent junctions of related electrical connections in circuit diagrams. That is, these nodes are points that are equivalent to the junctions of the related electrical connections in the circuit diagrams.

Below, the terms "first" and "second" are only used for descriptive purposes, and are not to be construed as indicating or implying the relative importance or implicitly indicating the number of indicated technical features. Thus, a feature defined with "first" or "second" may explicitly or implicitly include one or more of the features. In the description of the embodiments of the present disclosure, "a plurality of/the plurality of" means two or more unless otherwise specified.

Figure 1:
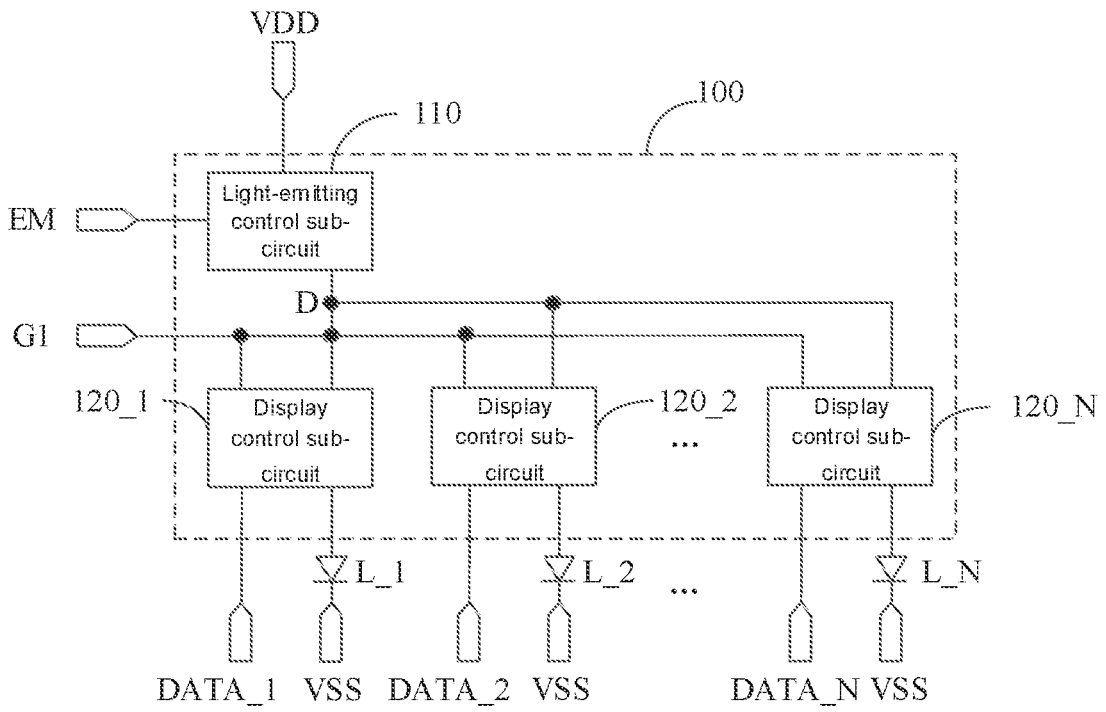
FIG. 1 shows a block diagram of a pixel driving circuit, in accordance with embodiments of the present disclosure.

FIG. 1 shows a block diagram of a pixel driving circuit in accordance with the embodiments of the present disclosure. As shown in FIG. 1, the pixel driving circuit 100 includes a light-emitting control sub-circuit 110 and a plurality of display control sub-circuits 120_1, 120_2, 120_3 . . . 120_N (referred to as display control sub-circuits 120 hereinafter).

The light-emitting control sub-circuit 110 is connected to a light-emitting control signal terminal EM, a power supply signal terminal VDD, and a light-emitting control node D. The light-emitting control sub-circuit 110 is configured to transmit a power supply signal from the power supply signal terminal VDD to the light-emitting control node D in response to a light-emitting control signal received from the light-emitting control signal terminal EM.

Each display control sub-circuit 120 is connected to the light-emitting control node D, a scan signal terminal G1, a data signal terminal DATA and a light-emitting element L. For example, as shown in FIG. 1, the display control sub-circuit 120_1 is connected to a data signal terminals DATA_1 and a light-emitting element L_1, the display control sub-circuit 120_2 is connected to a data signal terminal DATA_2 and a light-emitting element L_2, and so on. For another example, as shown in FIG. 1, the plurality of display control sub-circuits are connected to the same scan signal terminal G1.

Each display control sub-circuit 120 is configured to, in response to a scan signal received from the scan signal terminal G1, output a driving signal according to the power supply signal from the power supply signal terminal VDD at the light-emitting control node D and a data signal from the data signal terminal DATA, so as to drive the light-emitting element L to emit light. For example, in response to the scan signal received from the scan signal terminal G1, the display control sub-circuit 120_1 outputs a driving signal to drive the light-emitting element L_1 to emit light according to the power supply signal from the power supply signal terminal VDD at the light-emitting control node D and a data signal from the data signal terminal DATA_1. For another example, in response to the scan signal received from the scan signal terminal G1, the display control sub-circuit 120_2 outputs a driving signal according to the power supply signal from the power supply signal terminal VDD at the light-emitting control node D and a data signal from the data signal terminal DATA_2, so as to drive the light-emitting element L_2 to emit light.

In the pixel driving circuit in some embodiments of the present disclosure, the plurality of display control sub-circuits 120 are connected to the same light-emitting control circuit 110, which may reduce the number of light-emitting control sub-circuits 110. On this basis, in a case where the light-emitting control sub-circuit 110 includes at least one transistor, the number of transistors may be reduced, thereby simplifying the structure of the pixel driving circuit.

Figure 2:
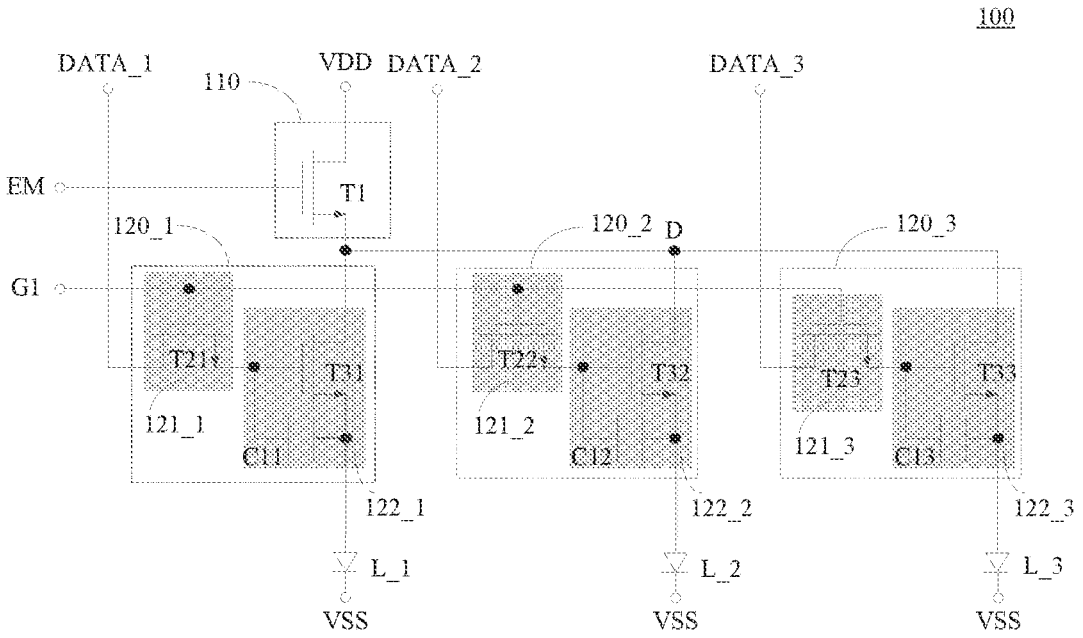
FIG. 2 shows a circuit diagram of a pixel driving circuit, in accordance with embodiments of the present disclosure.

In some examples, as shown in FIG. 2, the pixel driving circuit 100 includes the light-emitting control sub-circuit 110 and three display control sub-circuits 120_1, 120_2, and 120_3 (referred to as the display control sub-circuits 120 hereinafter). As shown in FIG. 2, the light-emitting control sub-circuit 110 includes a first transistor T1. A gate of the first transistor T1 is connected to the light-emitting control signal terminal EM, a first electrode of the first transistor T1 is connected to the power supply signal terminal VDD, and a second electrode of the first transistor T1 is connected to the light-emitting control node D.

In some embodiments, as shown in FIG. 2, the display control sub-circuit 120 includes a first control sub-circuit 121 and a first driving sub-circuit 122. The first control sub-circuit 121 is connected to the scan signal terminal G1, the data signal terminal DATA and the first driving sub-circuit 122. The first control sub-circuit 121 is configured to transmit the data signal from the data signal terminal DATA to the first driving sub-circuit in response to the scan signal received from the scan signal terminal G1. The first driving sub-circuit 122 is further connected to the light-emitting control node D and the light-emitting element L. The first driving sub-circuit is configured to output the driving signal according to the power supply signal from the power supply signal terminal VDD at the light-emitting control node D and the data signal from the data signal terminal DATA, so as to drive the light-emitting element L to emit light.

In some examples, the first control sub-circuit 121 includes a second transistor. The first driving sub-circuit 122 includes a third transistor and a first capacitor, and the third transistor is a driving transistor. A gate of the second transistor is connected to the scan signal terminal G1, a first electrode of the second transistor is connected to the data signal terminal DATA, and a second electrode of the second transistor is connected to a gate of the third transistor. A first electrode of the third transistor is connected to the light-emitting control node D, and a second electrode of the third transistor is connected to the light-emitting element L. A first terminal of the first capacitor is connected to the gate of the third transistor, and a second terminal of the first capacitor is connected to the second electrode of the third transistor, or the second terminal of the first capacitor is connected to the first electrode of the third transistor. It will be noted that a channel width-to-length ratio of the driving transistor is greater than a channel width-to-length ratio of other transistor that functions as a switch.

In some examples, as shown in FIG. 2, in the display control sub-circuit 120_1, a first control sub-circuit 121_1 includes a second transistor T21, and a first driving sub-circuit 122_1 includes a third transistor T31 and a first capacitor C11. In the display control sub-circuit 120_2, a first control sub-circuit 121_2 includes a second transistor T22, and a first driving sub-circuit 122_2 includes a third transistor T32 and a first capacitor C12. In the display control sub-circuit 120_3, a first control sub-circuit 121_3 includes a second transistor T23, and a first driving sub-circuit 122_3 includes a third transistor T33 and a first capacitor C13.

Considering the display control sub-circuit 120_1 as an example, a gate of the second transistor T21 is connected to the scan signal terminal G1, a first electrode of the second transistor T21 is connected to the data signal terminal DATA_1, and a second electrode of the second transistor T21 is connected to a gate of the third transistor T31. A first electrode of the third transistor T31 is connected to the light-emitting control node D, and a second electrode of the third transistor T31 is connected to the light-emitting element L_1. A first terminal of the first capacitor C11 is connected to the gate of the third transistor T31, and a second terminal is connected to the second electrode or the first electrode of the third transistor T31. The display control sub-circuits 120_2 and 120_3 have the same structure as the display control sub-circuit 120_1, which will not be repeated here.

In some examples, as shown in FIG. 2, the first transistor T1, the second transistors T21, T22 and T23, and the third transistors T31, T32 and T33 are all N-type transistors, such as N-type thin film transistors (TFTs). In this case, the second terminals of the first capacitors C11, C12 and C13 are connected to the second electrodes of the third transistors T31, T32 and T33, respectively.

Of course, the first transistor T1, the second transistors T21, T22 and T23, and the third transistors T31, T32 and T33 may also be P-type transistors, such as P-type thin film transistors. In this case, the second terminals of the first capacitors C11, C12 and C13 are connected to the first electrodes of the third transistors T31, T32 and T33, respectively.

It will be noted that a first electrode is one of a source and a drain of a transistor, and a second electrode is another one of the source and drain of the transistor. Since the source and the drain of the transistor may be symmetrical in structure, the source and the drain thereof may have no difference in structure. That is, the first electrode and the second electrode of the transistor in the embodiments of the present disclosure may have no difference in structure. For example, for a P-type transistor, a second electrode is referred to as a drain, and a first electrode is referred to as a source. For another example, for a N-type transistor, a first electrode is referred to as a drain, and a second electrode is referred to as a source.

Figure 9:
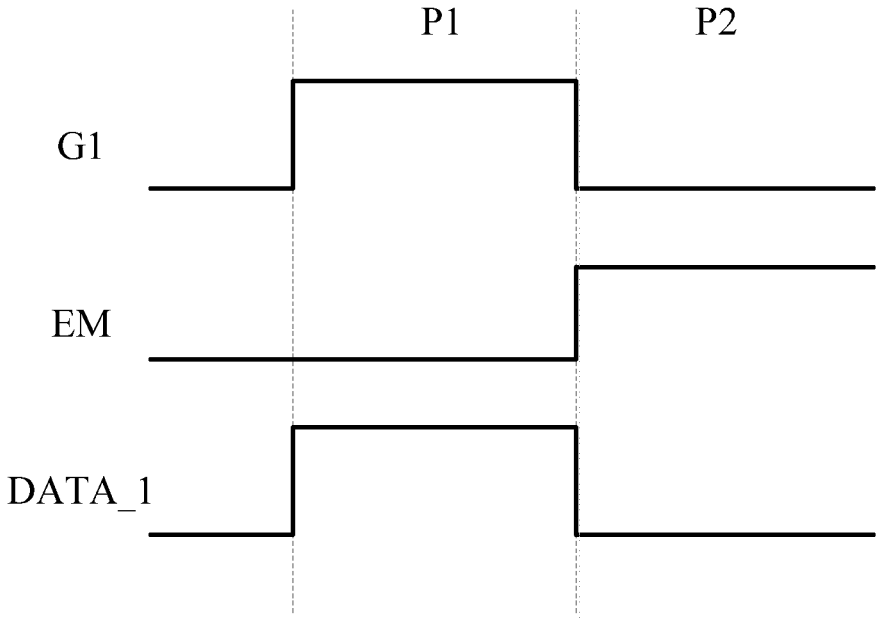
FIG. 9 shows a signal timing diagram of the pixel driving circuit in FIG. 2.

In an example where the first transistor T1, the second transistor T21 and the third transistor T31 in the display control sub-circuit 120_1 are the N-type transistors, an operating process of the display control sub-circuit 120_1 in FIG. 2 and the light-emitting control sub-circuit 110 connected thereto will be described below in combination with FIG. 9 (FIG. 9 shows a signal timing diagram of the pixel driving circuit in FIG. 2).

In a first phase P1, the scan signal and the light-emitting control signal are applied to the scan signal terminal G1 and the light-emitting control signal terminal EM, respectively. The light-emitting control signal is a low-voltage signal in the first phase P1, and the first transistor T1 is turned off. The scan signal is a high-voltage signal in the first phase P1, and the second transistor T21 is turned on. The data signal is applied to the data signal terminal DATA_1, and the data signal is transmitted to the gate of the third transistor T31 through the turned-on second transistor T21, so as to be stored in the first capacitor C11. This phase is also referred to as a data writing phase.

In a second phase P2, the scan signal is a low-voltage signal in the second phase P2, and the second transistor T21 is turned off. The light-emitting control signal is a high-voltage signal in the second phase P2, and the first transistor T1 is turned on. The power supply signal from the power supply signal terminal VDD is transmitted to the light-emitting control node D through the turned-on first transistor T1. A voltage of the data signal stored in the first capacitor C11 in the data writing phase and a voltage of the power supply signal at the light-emitting control node D makes the third transistor T31 generate a driving current from the source to the drain thereof, so as to drive the corresponding light-emitting element L_1 to emit light. This phase is also referred to as a light-emitting phase.

Operations of the display control sub-circuits 120_2 and 120_3 are similar to that of the display control sub-circuit 120_1, which will not be repeated here.

Figure 3:
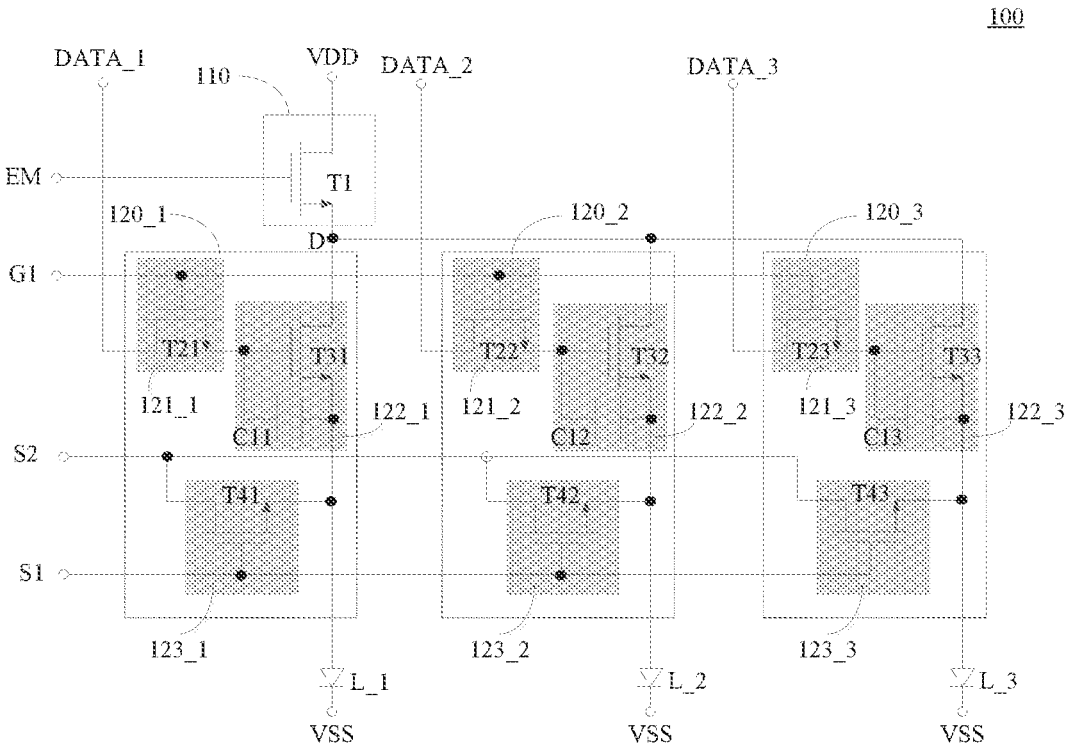
FIG. 3 shows a circuit diagram of another pixel driving circuit, in accordance with embodiments of the present disclosure.

In some embodiments, as shown in FIG. 3, each display control sub-circuit 120 in the pixel driving circuit 100 further includes a second control sub-circuit 123. The second control sub-circuit 123 is connected to a first signal terminal S1, a second signal terminal S2 and the third transistor.

In some examples, the second control sub-circuit 123 includes a fourth transistor. A gate of the fourth transistor is connected to the first signal terminal S1, a first electrode of the fourth transistor is connected to the second signal terminal S2, and a second electrode of the fourth transistor is connected to the second electrode of the third transistor. For the sake of brevity, differences will be mainly described in detail below.

In some examples, as shown in FIG. 3, the pixel driving circuit 100 includes the light-emitting control sub-circuit 110 and three display control sub-circuits 120_1, 120_2, and 120_3. The display control sub-circuit 120_1 includes the first control sub-circuit 121_1, the first driving sub-circuit 122_1 and the second control sub-circuit 123_1. The display control sub-circuit 120_2 includes the first control sub-circuit 121_2, the first driving sub-circuit 122_2 and the second control sub-circuit 123_2. The display control sub-circuit 120_3 includes the first control sub-circuit 121_3, the first driving sub-circuit 122_3 and the second control sub-circuit 123_3.

Considering the display control sub-circuit 120_1 as an example, as shown in FIG. 3, the first control sub-circuit 121_1 includes the second transistor T21, the first driving sub-circuit 122_1 includes the third transistor T31 and the first capacitor C11, and the second control sub-circuit 123_1 includes a fourth transistor T41. A gate of the fourth transistor T41 is connected to the first signal terminal S1, a first electrode of the fourth transistor T41 is connected to the second signal terminal S2, and a second electrode of the fourth transistor T41 is connected to the second electrode of the third transistor T31. That is, the second electrode of the fourth transistor T41 is further connected to the light-emitting element L_1. The display control sub-circuits 120_2 and 120_3 have the same structure as the display control sub-circuit 120_1, which will not be repeated here.

In some examples, as shown in FIG. 3, the first transistor T1, the second transistors T21, T22 and T23, the third transistors T31, T32 and T33, and the fourth transistors T41, T42 and T43 are all N-type transistors, such as N-type thin film transistors.

Figure 4:
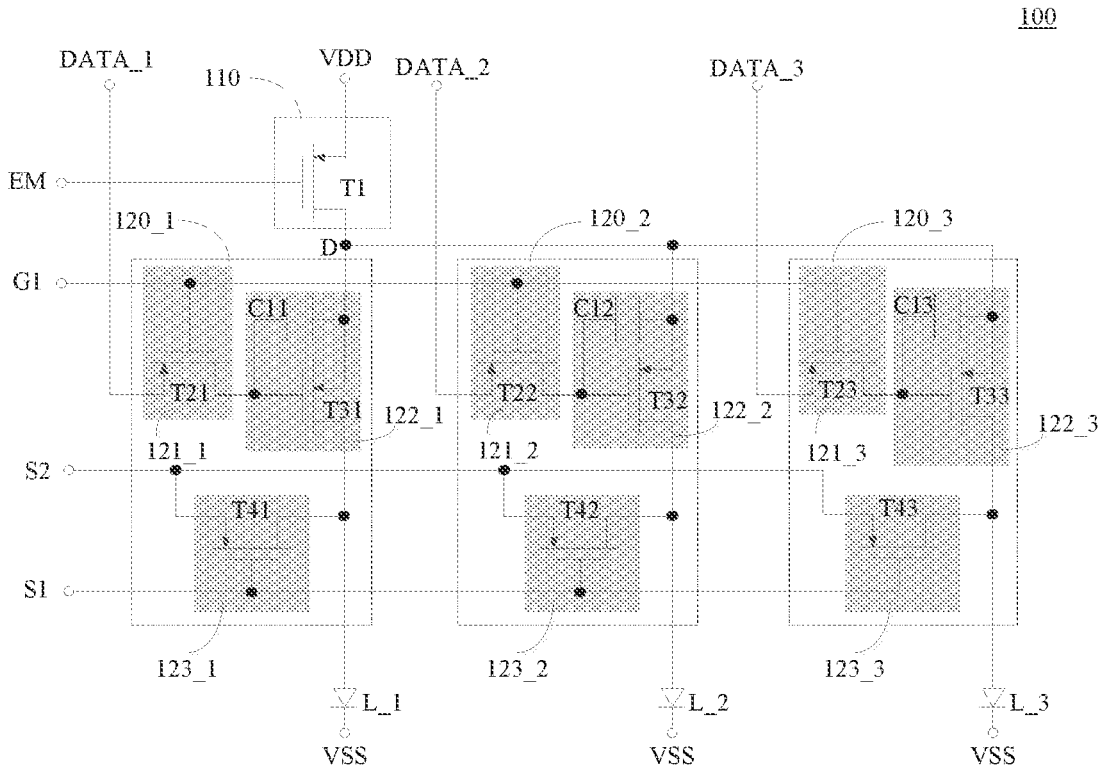
FIG. 4 shows a circuit diagram of yet another pixel driving circuit, in accordance with embodiments of the present disclosure.

FIG. 4 shows a circuit diagram of another example of a pixel driving circuit in accordance with embodiments of the present disclosure. The pixel driving circuit 100 shown in FIG. 4 is similar to the pixel driving circuit 100 in FIG. 3, and differences are at least that the transistors in the pixel driving circuit 100 are P-type transistors, and the second terminal of the first capacitor is connected to the first electrode of the third transistor.

In some examples, the second signal terminal S2 is a reset signal terminal. In this case, the second control sub-circuit 123 is configured to, in response to a control signal received from the first signal terminal S1, transmit a reset signal from the second signal terminal S2 to the second electrode of the third transistor, so as to reset the light-emitting element L connected to the second electrode of the third transistor.

Figure 10:
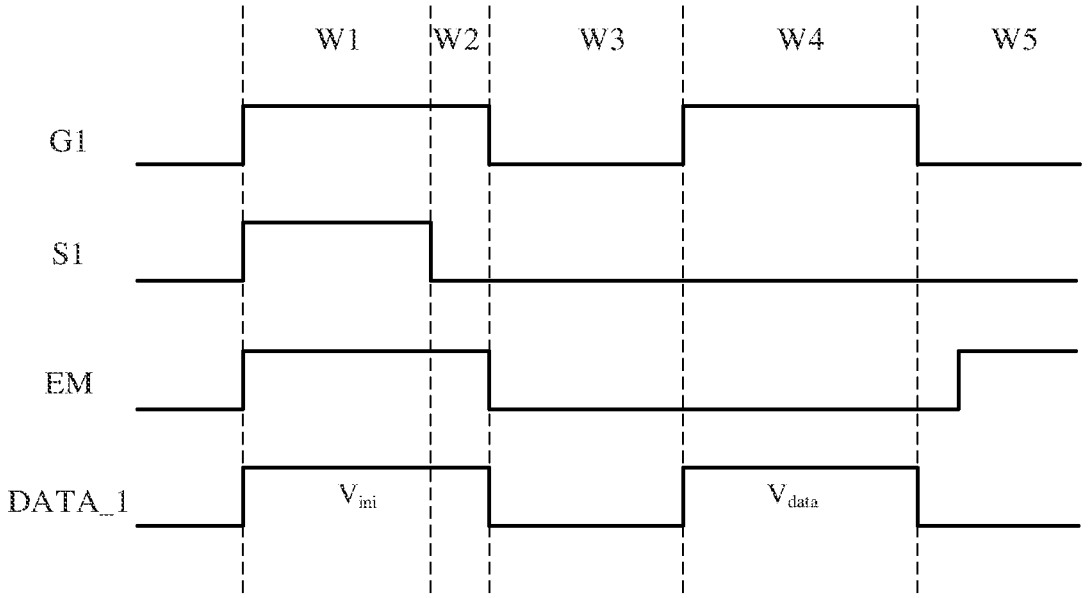
FIG. 10 shows a signal timing diagram of the pixel driving circuit in FIG. 3.

In an example where the first transistor T1, the second transistor T21, the third transistor T31 and the fourth transistor T41 in the display control sub-circuit 120_1 are all N-type transistors, an operating process of the display control sub-circuit 120_1 in FIG. 3 and the light-emitting control sub-circuit 110 connected thereto will be described below in combination with FIG. 10 (FIG. 10 shows a signal timing diagram of the pixel driving circuit in FIG. 3).

In a first phase W1, the scan signal, the control signal and the light-emitting control signal are applied to the scan signal terminal G1, the first signal terminal S1 and the light-emitting control terminal EM, respectively. Since the scan signal, the control signal and the light-emitting control signal are all high-voltage signals in the first phase W1, the first transistor T1, the second transistor T21, the third transistor T31 and the fourth transistor T41 are all turned on. An initial voltage $V_{ini}$ is applied to the data signal terminal DATA_1, and is transmitted to the gate of the third transistor T31 through the turned-on second transistor T21, so as to be stored in the first capacitor C11. The first transistor T1 is turned on, so as to transmit the power supply signal from the power supply signal terminal VDD to the light-emitting control node D. The fourth transistor T41 is turned on to transmit the reset signal from the second signal terminal S2 to the second electrode of the third transistor T31 and an anode of the light-emitting element L_1, so as to reset the anode of the light-emitting element L_1, thereby avoiding an influence of residual electrical signals at the anode of the light-emitting element L_1 in a previous frame on a screen in a current frame. The initial voltage $V_{ini}$ may be set to be greater than a sum of a voltage of the reset signal and a threshold voltage ($V_{th}$) of the third transistor T31. Since the third transistor T31 is the N-type transistor, the second electrode of the third transistor T31 is a source. In this way, a voltage difference between the gate and the source of the third transistor T31 is greater than the threshold voltage of the third transistor T31, so that the third transistor T31 is turned on. This phase is also referred to as a reset phase.

It will be noted that, in the first phase W1, the first transistor T1 is also turned on, and the power supply signal from the power supply signal terminal VDD is transmitted to the light-emitting control node D. However, since both a resistance of the first transistor T1 and a resistance of the third transistor T31 are greater than a resistance of the fourth transistor T41, the power supply signal from the power supply signal terminal VDD received at the light-emitting control node D do not affect the voltage of the second electrode of the third transistor T31, and thus the light-emitting element L_1 do not emit light.

In a second phase W2, the control signal is a low-voltage signal in the second phase W2, and the fourth transistor T41 is turned off. The scan signal and the light-emitting control signal are still high-voltage signals in the second phase W2, and the first transistor T1, the second transistor T21 and the third transistor T31 maintain in the turned-on state. In the second phase W2, the initial voltage $V_{ini}$ is continuously applied to the data signal terminal DATA_1, and the voltage $V_g$ of the gate of the third transistor T31 is $V_{ini}$. The power supply signal from the power supply signal terminal VDD is transmitted to the light-emitting control node D, and the third transistor T31 transmits the power supply signal from the light-emitting control node D to the second terminal of the first capacitor C11, so as to charge the first capacitor C11 until the third transistor T31 is turned off. At this time, a voltage difference between the two terminals of the first capacitor C11 (i.e., the voltage difference $V_{gs}$ between the gate and the source of the third transistor T31) is equal to $V_{th}$ (i.e., $V_{gs}=V_{th}$). The voltage $V_s$ of the source of the third transistor T31 is equal to $V_g-V_{gs}$, and is further equal to $V_{ini}-V_{th}$ (i.e., $V_s=V_g-V_{gs}=V_{ini}-V_{th}$). This phase is also referred to as a compensation phase.

In a third phase W3, the scan signal, the control signal, and the light-emitting control signal are all low-voltage signals in the third phase W3, and the first transistor T1, the second transistor T21 and the fourth transistor T41 are all turned off. This phase is also referred to as a transition phase.

In a fourth phase W4, the scan signal is a high-voltage signal in the fourth phase W4, and the second transistor T21 is turned on. The control signal and the light-emitting control signal are low-voltage signals in the fourth phase W4. The data signal $V_{data}$ is applied to the data signal terminal DATA_1, and the data signal is transmitted to the gate of the third transistor T31 through the turned-on second transistor T21, so as to be stored in the first capacitor C11. This phase is also referred to as a data writing phase.

In a fifth phase W5, the scan signal and the control signal are low-voltage signals in the fifth phase W5. The light-emitting control signal is a high-voltage signal in the fifth phase W5, and the first transistor T1 is turned on, so that the power supply signal from the power supply signal terminal VDD is transmitted to the light-emitting control node D. A voltage of the data signal stored in the first capacitor C11 in the data writing phase and a voltage of the power supply signal at the light-emitting control node D makes the third transistor T31 generate a driving current to drive the corresponding light-emitting element L_1 to emit light. In some examples, as shown in FIG. 10, in the fifth phase W5, the light-emitting control signal from the light-emitting control signal terminal EM changes into a high-voltage signal again after a preset time, so as to wait for the data signal to be fully written. This phase is also referred to as a light-emitting phase.

In the second phase W2 to the fifth phase W5, the voltage $V_s$ of the source of the third transistor T31 is equal to $V_{ini}-V_{th}$ (i.e., $V_s=V_{ini}-V_{th}$). In the fourth phase W4 and the fifth phase W5, the voltage $V_g$ of the gate of the third transistor T31 is equal to $V_{data}$ (i.e., $V_g=V_{data}$). Then, in the fifth phase W5, the voltage difference $V_{gs}$ between the gate and source of the third transistor T31 is equal to $V_g-V_s$, and is further equal to $V_{data}-(V_{ini}-V_{th})$ (i.e., $V_{gs}=V_g-V_s=V_{data}(V_{ini}-V_{th})$). The driving current I generated in the third transistor T3 is:

$$
\begin{aligned}
I &= \frac{1}{2}\mu C_{OX}\frac{W}{L}(V_{gs}-V_{th})^2 \\
&= \frac{1}{2}\mu C_{OX}\frac{W}{L}(V_{data}-V_{ini}+V_{th}-V_{th})^2 \\
&= \frac{1}{2}\mu C_{OX}\frac{W}{L}(V_{data}-V_{ini})^2
\end{aligned}
$$

Here, W/L is a width-to-length ratio of the third transistor T31, $C_{ox}$ is a dielectric constant of a channel insulating layer, and p is a channel carrier mobility.

It can be seen that the driving current I is only related to the structure of the third transistor T31, the data signal $V_{data}$ output from the data signal terminal DATA_1 and the initial voltage $V_{ini}$ output from the data signal terminal DATA_1, and is unrelated to the threshold voltage of the third transistor T31, thereby compensating for the threshold voltage of the third transistor T31.

Operating processes of the display control sub-circuits 120_2 and 120_3 are similar to the operating process of the display control sub-circuit 120_1, which will not be repeated here.

Figure 11:
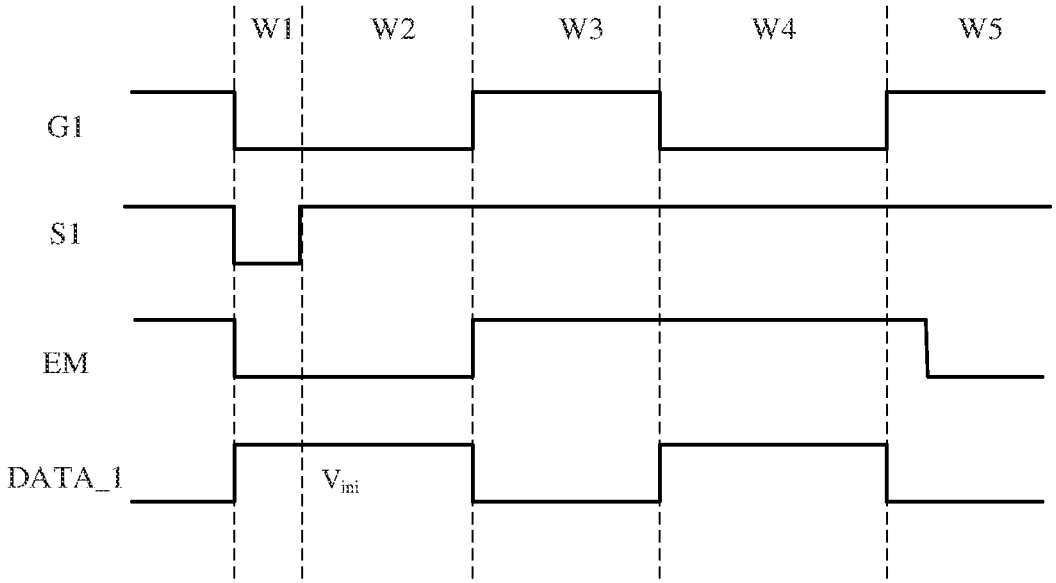
FIG. 11 shows a signal timing diagram of the pixel driving circuit in FIG. 4.

FIG. 11 shows a signal timing diagram of signals of the pixel driving circuit in FIG. 4. Since the difference between the pixel driving circuit 100 in FIG. 4 and the pixel driving circuit 100 in FIG. 3 is mainly that the pixel driving circuit 100 in FIG. 4 adopts P-type transistors, the operating process of the pixel driving circuit 100 in FIG. 4 is similar to that of the pixel driving circuit 100 in FIG. 3, which will not be repeated here.

In some other examples, the second signal terminal S2 is a sensing signal terminal. In this case, the second control sub-circuit 123 is configured to output the parameter of the third transistor to the second signal terminal S2 in response to the control signal received from the first signal terminal S1.

Considering the display control sub-circuit 120_1 as an example, the control signal is applied to the first signal terminal S1 to turn on the fourth transistor T41. The parameter of the third transistor T31 are transmitted to the second signal terminal S2 through the turned-on fourth transistor T41. In this case, the second signal terminal S2 may be connected to an analog-to-digital converter through a switch, so as to externally compensate for the threshold voltage of the third transistor T31.

In yet other examples, the second control sub-circuit 123 is configured to: in the reset phase, in response to the control signal received from the first signal terminal S1, transmit the reset signal from the second signal terminal S2 to the second electrode of the third transistor, so as to reset the light-emitting element connected to the second electrode of the third transistor; and in the compensation phase, output the parameter of the third transistor to the second signal terminal S2 in response to the control signal received from the first signal terminal S1.

Considering the display control sub-circuit 120_1 as an example, in the reset phase, the control signal is applied to the first signal terminal S1 to turn on the fourth transistor T41. The reset signal from the second signal terminal S2 is transmitted to the second electrode of the third transistor and the anode of the light-emitting element L_1 through the turned-on fourth transistor T41, so as to reset the light-emitting element L_1. In the compensation phase, the control signal is applied to the first signal terminal S1 to turn on the fourth transistor T41, so as to output the parameter of the third transistor T31 to the second signal terminal S2, so as to externally compensate for the third transistor T31.

Figure 5A:
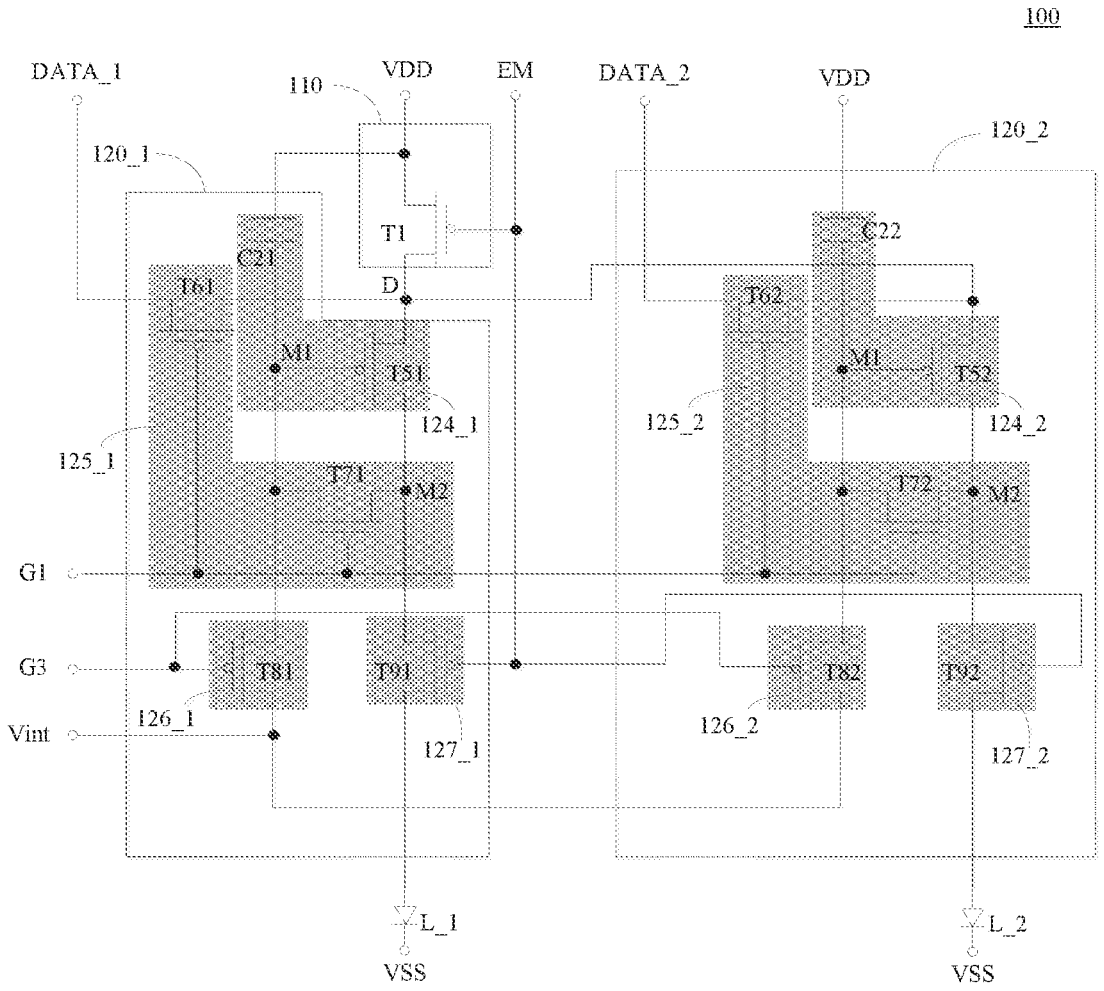
FIG. 5A shows a circuit diagram of yet another pixel driving circuit, in accordance with embodiments of the present disclosure.
Figure 5B:
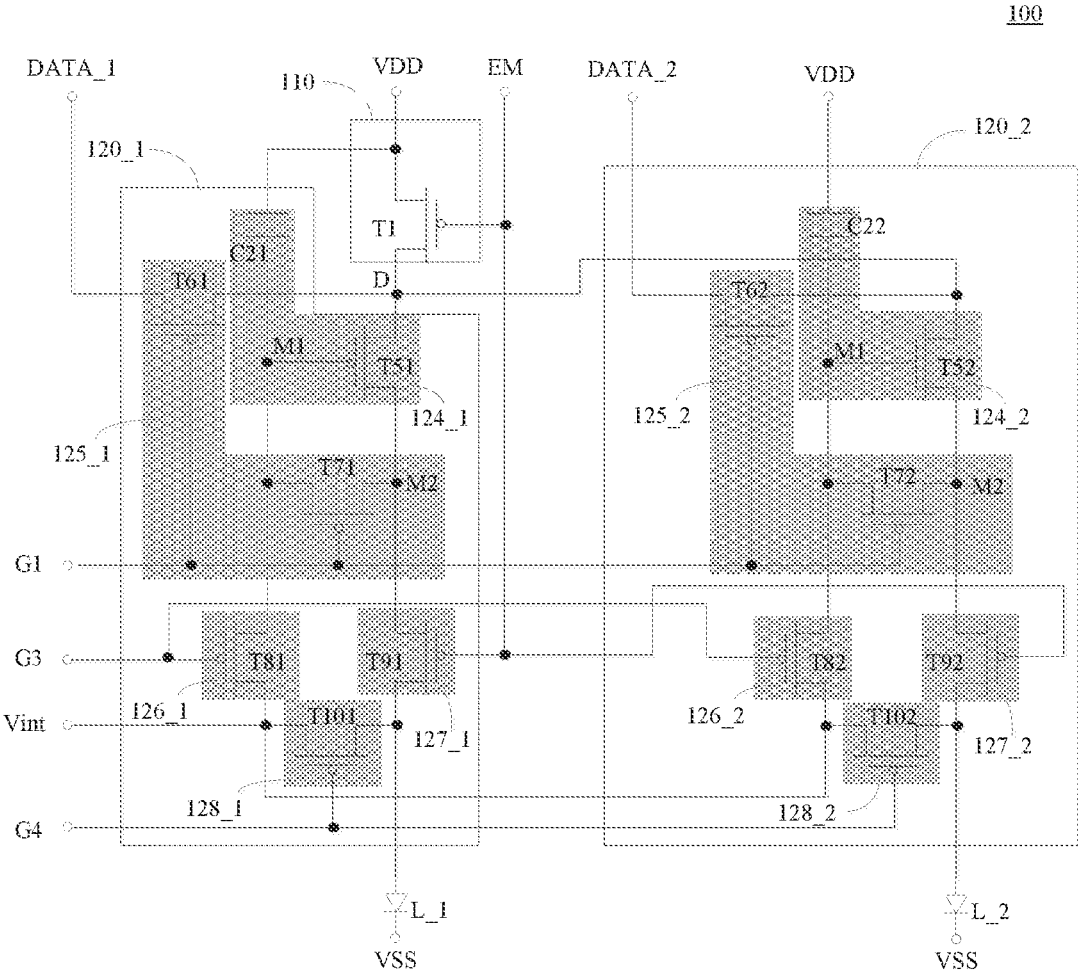
FIG. 5B shows a circuit diagram of yet another pixel driving circuit, in accordance with embodiments of the present disclosure.

In some embodiments, as shown in FIGS. 5A and 5B, each display control sub-circuit 120 includes a second driving sub-circuit 124, a writing sub-circuit 125, a first reset sub-circuit 126, and a third control sub-circuit 127. The second driving sub-circuit 124 includes a fifth transistor and a second capacitor, and the fifth transistor is a driving transistor. A gate of the fifth transistor is connected to a first node M1, a first electrode of the fifth transistor is connected to the light-emitting control node D, and a second electrode of the fifth transistor is connected to a second node M2. A first terminal of the second capacitor is connected to the first node N1, and a second terminal of the second capacitor is connected to the power supply signal terminal VDD. The writing sub-circuit 125 is connected to the scan signal terminal G1, the data signal terminal DATA, the light-emitting control node D, the first node M1 and the second node M2. The writing sub-circuit 125 is configured to, in response to the scan signal received from the scan signal terminal G1, transmit the data signal from the data signal terminal DATA to the first node M1, and compensate for a threshold voltage of the fifth transistor. The first reset sub-circuit 126 is connected to a first reset control signal terminal G3, an initialization signal terminal Vint and the first node M1. The first reset sub-circuit 126 is configured to transmit an initialization signal from the initialization signal terminal Vint to the first node M1 in response to a first reset control signal received from the first reset control signal terminal G3. The third control sub-circuit 127 is connected to the light-emitting control signal terminal EM, the second node M2 and the light-emitting element L. The third control sub-circuit 127 is configured to connect the light-emitting element L to the second node M2 in response to the light-emitting control signal received from the light-emitting control signal terminal EM.

In some examples, the writing sub-circuit 125 includes a sixth transistor and a seventh transistor. A gate of the sixth transistor is connected to the scan signal terminal G1, a first electrode of the sixth transistor is connected to the data signal terminal DATA, and a second electrode of the sixth transistor is connected to the light-emitting control node D. A gate of the seventh transistor is connected to the scan signal terminal G1, a first electrode of the seventh transistor is connected to the second node M2, and a second electrode of the seventh transistor is connected to the first node M1.

In some examples, the first reset sub-circuit 126 includes an eighth transistor. A gate of the eighth transistor is connected to the first reset control signal terminal G3, a first electrode of the eighth transistor is connected to the initialization signal terminal Vint, and a second electrode of the eighth transistor is connected to the first node M1.

In some examples, the third control sub-circuit 127 includes a ninth transistor. A gate of the ninth transistor is connected to the light-emitting control signal terminal EM, a first electrode of the ninth transistor is connected to the second node M2, and a second electrode of the ninth transistor is connected to the anode of the light-emitting element L.

In some embodiments, as shown in FIG. 5B, the display control sub-circuit further includes a second reset sub-circuit 128. The second reset sub-circuit 128 is connected to a second reset control signal terminal G4, the initialization signal terminal Vint and the second electrode of the ninth transistor. The second reset sub-circuit 128 is configured to transmit the initialization signal from the initialization signal terminal Vint to the second electrode of the ninth transistor in response to a second reset control signal received from the second reset control signal terminal G4. Since the second electrode of the ninth transistor is connected to the anode of the light-emitting element L, the initialization signal from the initialization signal terminal Vint is transmitted to the second electrode of the ninth transistor, so as to reset the anode of the light-emitting element L connected to the second electrode of the ninth transistor.

In some examples, the second reset sub-circuit 128 includes a tenth transistor. A gate of the tenth transistor is connected to the second reset control signal terminal G4, a first electrode of the tenth transistor is connected to the initialization signal terminal Vint, and a second electrode of the tenth transistor is connected to the second electrode of the ninth transistor.

The following description is made by taking the display control sub-circuit 120_1 as an example. As shown in FIG. 5B, the display control sub-circuit 120_1 includes a second driving sub-circuit 124_1, a writing sub-circuit 125_1, a first reset sub-circuit 126_1, a third control sub-circuit 127_1 and a second reset sub-circuit 128_1.

The second driving sub-circuit 124_1 includes a fifth transistor T51 and a second capacitor C21, and the fifth transistor T51 is the driving transistor. A gate of the fifth transistor T51 is connected to the first node M1, a first electrode of the fifth transistor T51 is connected to the light-emitting control node D, and a second electrode of the fifth transistor T51 is connected to the second node M2. A first terminal of the second capacitor C21 is connected to the first node M1, and a second terminal of the second capacitor C21 is connected to the power supply signal terminal VDD. The writing sub-circuit 125_1 includes a sixth transistor T61 and a seventh transistor T71. A gate of the sixth transistor T61 is connected to the scan signal terminal G1, a first electrode of the sixth transistor T61 is connected to the data signal terminal DATA_1, and a second electrode of the sixth transistor T61 is connected to the light-emitting control node D. A gate of the seventh transistor T71 is connected to the scan signal terminal G1, a first electrode of the seventh transistor T71 is connected to the second node M2, and a second electrode of the seventh transistor T71 is connected to the first node M1. The first reset sub-circuit 126_1 includes an eighth transistor T81. A gate of the eighth transistor T81 is connected to the first reset control signal terminal G3, a first electrode of the eighth transistor T81 is connected to the initialization signal terminal Vint, and a second electrode of the eighth transistor T81 is connected to the first node M1. The third control sub-circuit 127_1 includes a ninth transistor T91. A gate of the ninth transistor T91 is connected to the light-emitting control signal terminal EM, a first electrode of the ninth transistor T91 is connected to the second node M2, and a second electrode of the ninth transistor T91 is connected to the anode of the light-emitting element L_1. The second reset sub-circuit 128_1 includes a tenth transistor T101. A gate of the tenth transistor T101 is connected to the second reset control signal terminal G4, a first electrode of the tenth transistor T101 is connected to the initialization signal terminal Vint, and a second electrode of the tenth transistor T101 is connected to the second electrode of the ninth transistor T91 (i.e., connected to the anode of the light-emitting element L_1).

It will be noted that the pixel driving circuit 100 in FIG. 5A or 5B illustrates two display control sub-circuits 120, the display control sub-circuit 120_2 has the same structure as the display control sub-circuit 120_1, which will not be repeated here.

Figure 12:
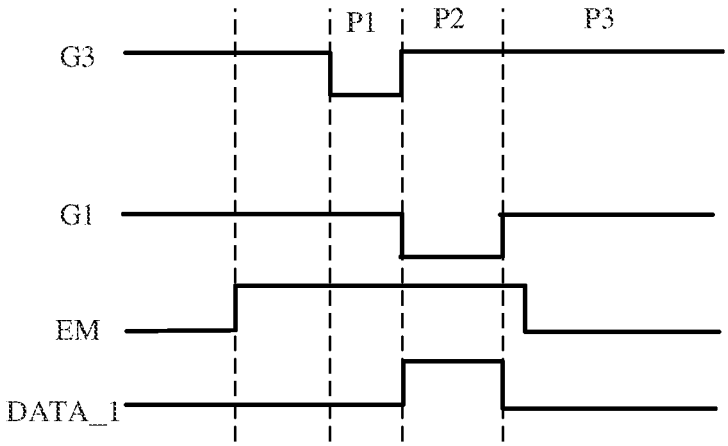
FIG. 12 shows a signal timing diagram of the pixel driving circuit in FIG. 5.

In an example where the fifth transistor T51, the sixth transistor T61, the seventh transistor T71, the eighth transistor T81 and the ninth transistor T91 in the display control sub-circuit 120_1 are all P-type transistors, an operating process of the display control sub-circuit 120_1 in FIG. 5A and the light-emitting control sub-circuit 110 connected thereto will be described below in combination with FIG. 12 (FIG. 12 shows a signal timing diagram of the pixel driving circuit in FIG. 5A).

In an initialization phase P1, the first reset control signal is applied to the first reset control signal terminal G3. Since the first reset control signal is a low-voltage signal in the initialization phase P1, the eighth transistor T81 is turned on. The initialization signal from the initialization signal terminal Vint is transmitted to the first node M1 through the turned-on eighth transistor T81, so as to initialize the first node M1, thereby avoiding an influence of residual electrical signals at the first node M1 in a previous frame on a screen in a current frame.

In addition, in this phase, the scan signal is applied to the scan signal terminal G1, and the light-emitting signal is applied to the light-emitting control signal terminal EM. Since the scan signal and the light-emitting control signal are high-voltage signals in the initialization phase P1, the first transistor T1, the sixth transistor T61, the seventh transistor T71 and the ninth transistor T91 are all turned off.

In a data writing phase P2, the first reset control signal is a high-voltage signal in the data writing phase P2, and the eighth transistor T81 is turned off. The light-emitting control signal is still a high-voltage signal in the data writing phase P2. The scan signal is a low-voltage signal in the data writing phase P2, and the sixth transistor T61 and the seventh transistor T71 are turned on. The data signal from the data signal terminal DATA_1 is transmitted to the light-emitting control node D through the turned-on sixth transistor T61. Since the seventh transistor T71 short-circuits the second electrode and the gate of the fifth transistor T51 to form a diode structure, the data signal at the light-emitting control node D is transmitted to the first node M1 through the fifth transistor T51. When a voltage difference between a voltage of the first node M1 and a voltage of the light-emitting control node D is reduced to a threshold voltage of the fifth transistor T51, the fifth transistor is turned off.

In the data writing phase P2, the voltage of the first node M1 is $V_{data}+V_{th}$, and is stored in the second capacitor C21, $V_{data}$ is the voltage of the data signal, $V_{th}$ is the threshold voltage of the fifth transistor T51.

In a light-emitting phase P3, the first reset control signal is still a high-voltage signal in the light-emitting phase P3. The scan signal is a high-voltage signal in the light-emitting phase P3, and the sixth transistor T61 and the seventh transistor T71 are turned off. The light-emitting control signal is a low-voltage signal in the light-emitting phase P3, and the first transistor T1 and the ninth transistor T91 are turned on. The power supply signal from the power supply signal terminal VDD is transmitted to the light-emitting control node D through the turned-on transistor T1. The fifth transistor T51 outputs a driving current due to control of the voltage of the first node M1 and the power supply signal from the power supply signal terminal VDD, and the driving current is transmitted to the light-emitting element L_1 through the ninth transistor T91, so as to make the light-emitting element L_1 emit light.

In the light-emitting phase P3, the voltage of the first node M1 is $V_{data}+V_{th}$, the voltage of the light-emitting control node D is $V_{dd}$ (a voltage of the power supply signal), and a voltage difference $V_{gs}$ between the gate and the source of the fifth transistor T51 is equal to $V_g-V_s$, and is further equal to $V_{data}+V_{th}-V_{dd}$ (i.e., $V_{gs}=V_g-V_s=V_{data}+V_{th}-V_{dd}$).

In a case where a value obtained by subtracting the threshold voltage $V_{th}$ of the fifth transistor T51 from the voltage difference $V_{gs}$ between the gate and the source of the fifth transistor T51 is less than or equal to a voltage difference $V_{ds}$ between the drain and the source of the fifth transistor T51, i.e., $V_{gs}-V_{th}\leq V_{ds}$, the fifth transistor T51 is able to be in a saturation turned-on state, and in this case, the driving current I flowing through the fifth transistor T51 is:

$$\begin{aligned} I &= \frac{1}{2}\mu C_{OX}\frac{W}{L}(V_{gs}-V_{th})^2 \\ &= \frac{1}{2}\mu C_{OX}\frac{W}{L}(V_{data}+V_{th}-V_{dd}-V_{th})^2 \\ &= \frac{1}{2}\mu C_{OX}\frac{W}{L}(V_{data}-V_{dd})^2 \end{aligned}$$

Here, W/L is a width-to-length ratio of the fifth transistor T51, $C_{ox}$ is a dielectric constant of a channel insulating layer, and μ is a channel carrier mobility.

It can be seen that the driving current of the fifth transistor T51 is only related to the structure of the fifth transistor T51, the data signal output from the data signal terminal DATA_1 and the power signal output from the power signal terminal VDD, and is unrelated to the threshold voltage $V_{th}$ of the fifth transistor T51, so as to internally compensate for the threshold voltage $V_{th}$ of the fifth transistor T51.

In addition, for the pixel driving circuit shown in FIG. 5B, in the initialization phase P1 or the other phases, the second reset control signal is applied to the second reset control signal terminal G4. Since the second reset control signal is a low-voltage signal, the tenth transistor T101 is turned on. The initialization signal from the initialization signal terminal Vint is transmitted to the anode of light-emitting element L_1 through the turned-on tenth transistor T101, so as to reset the anode of the light-emitting element L_1, thereby avoiding an influence of residual voltages at the anode of the light-emitting element L_1 at an end of a screen in a frame on a screen in a next frame.

The above are merely examples, the timing of the pixel driving circuits in the embodiments of the present disclosure is not limited thereto, and different signal timings may be adopted for display control sub-circuits of different structures.

It should be noted that although two or three display control sub-circuits are exemplarily illustrated in the embodiments described with reference to FIGS. 2 to 5B, those skilled in the art should understand that the embodiments of the present disclosure are not limited thereto, and display control sub-circuits of other suitable number may be selected as needed.

In addition, although the display control sub-circuits with specific structures are exemplarily illustrated in the embodiments of the present disclosure, those skilled in the art should understand that the embodiments of the present disclosure are not limited thereto, and display control sub-circuits with any other suitable structures may be selected as needed.

For the light-emitting control sub-circuit 110, although the light-emitting control sub-circuit is described by taking the first transistor as an example in the embodiments described with reference to FIGS. 2 to 5B, the embodiments of the present disclosure are not limited thereto, and other suitable light-emitting control sub-circuits may be used as needed, as long as a plurality of display control sub-circuits are able to share one light-emitting control sub-circuit.

Some embodiments of the present disclosure provide a display panel. The display panel includes a plurality of pixel driving circuit 100 and a plurality of light-emitting elements L. The pixel driving circuit may be implemented by the pixel driving circuit in any one of the above embodiments. Each light-emitting element L is connected to a corresponding display control sub-circuit 120, and each light-emitting element L and the corresponding display control sub-circuit 120 are located in a same sub-pixel region. In each pixel driving circuit 100, the light-emitting control sub-circuit 110 and one of the plurality of display control sub-circuits 120 may be located in a same sub-pixel region.

Figure 6A:
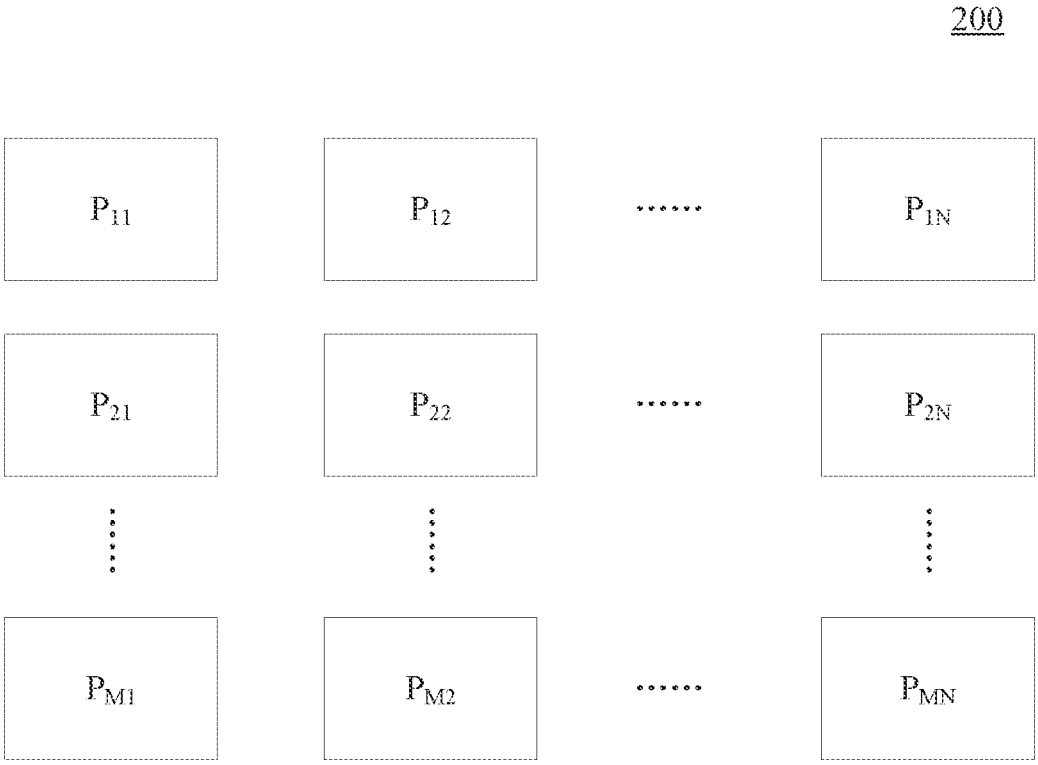
FIG. 6A shows a schematic top view of a display panel, in accordance with embodiments of the present disclosure.

As shown in FIG. 6A, the display panel 200 has a plurality of sub-pixel regions, and the plurality of sub-pixel regions $P_{11}$, $P_{12}$ . . . $P_{MN}$ are arranged in an array, M and N are positive integers. All structures located in any sub-pixel region in the display panel 200 constitute one sub-pixel.

Figure 6B:
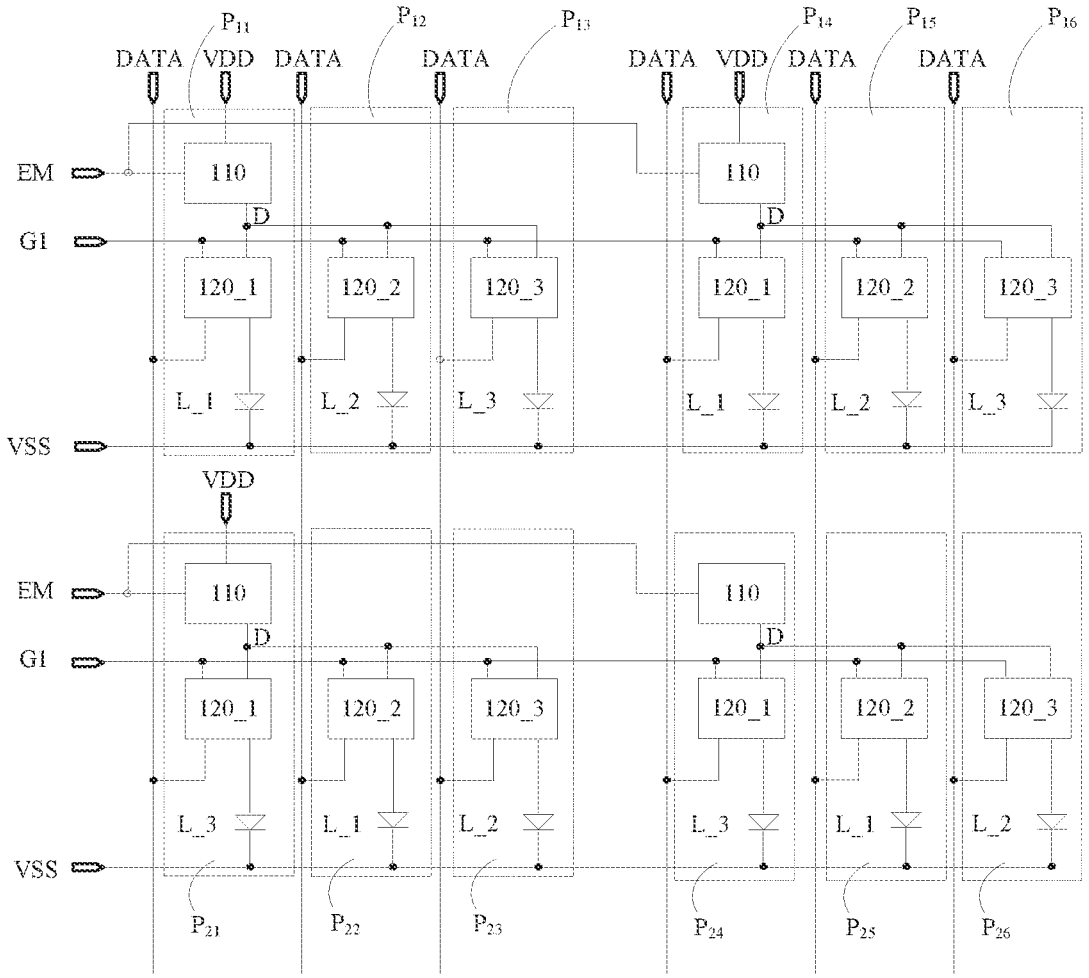
FIG. 6B shows a schematic diagram of a display panel, in accordance with embodiments of the present disclosure.

In some examples, as shown in FIG. 6B, light-emitting control signal terminals EM connected to light-emitting control sub-circuits 110 located in sub-pixel regions in a same row are connected to one another, and scan signal terminals G1 connected to display control sub-circuits 120 located in sub-pixel regions in a same row are connected to one another. For example, in FIG. 6B, light-emitting control signal terminals EM connected to light-emitting control sub-circuits 110 located in sub-pixel regions in a first row are connected together, so that sub-pixels in the first row receive the light-emitting control signal for the sub-pixels in the first row. Scan signal terminals G1 connected to display control sub-circuits 120 located in the sub-pixel regions in the first row are connected together, so that the sub-pixels in the first row receive the scan signal for the sub-pixels in the first row. Light-emitting control signal terminals EM connected to light-emitting control sub-circuits 110 located in sub-pixel regions in a second row are connected together, so that sub-pixels in the second row receive the light-emitting control signal for the sub-pixels in the second row. Scan signal terminals G1 connected to display control sub-circuits 120 located in the sub-pixel regions in the second row are connected together, so that the sub-pixels in the second row receive the scan signal for the sub-pixels in the second row.

Data signal terminals DATA connected to display control sub-circuits 120 located in sub-pixel regions in a same column are connected to one another. For example, in FIG. 6B, data signal terminals DATA connected to display control sub-circuits 120 located in sub-pixel regions in a first column are connected to one another, so that sub-pixels in the first column receive the data signal for the sub-pixels in the first column. Data signal terminals DATA connected to display control sub-circuits 120 located in sub-pixel regions in a second column are connected to one another, so that sub-pixels in the second column receive the data signal for the sub-pixels in the second column, and so on.

It will be noted that only four pixel driving circuits are shown in FIG. 6B, those skilled in the art should understand that this is only an illustration, and the number and the array arrangement of pixel driving circuits may be set as needed.

In some embodiments, the plurality of display control sub-circuits 120 in each pixel driving circuit 100 are located in respective sub-pixel regions in a same row, respectively. For example, the plurality of display control sub-circuits include N display control sub-circuits located in sub-pixel regions in a same row, and each display control sub-circuit is located in a corresponding sub-pixel region. N is an integer greater than 1, and the value of N may be set as needed. For example, N is set to be equal to the number of sub-pixels in a row or the number of some of sub-pixels in a row in the display panel.

In some examples, as shown in FIG. 6B, the plurality of display control sub-circuits 120 in each pixel driving circuit 100 include three display control sub-circuits, and the three display control sub-circuits 120 include a first display control sub-circuit 120_1, a second display control sub-circuit 120_2 and a third display control sub-circuit 120_3. The plurality of light-emitting elements L include first light-emitting elements L_1 that emit red light, second light-emitting elements L_2 that emit green light and third light-emitting elements L_3 that emit blue light.

The first display control sub-circuit 120_1 is connected to an anode of the first light-emitting element L_1, the second display control sub-circuit 120_2 is connected to an anode of the second light-emitting element L_2, and the third display control sub-circuit 120_3 is connected to an anode of the third light-emitting element L_3. A cathode of each light-emitting element L is connected to a reference signal terminal VSS.

In operation, the driving signal output from each display control sub-circuit 120 in the pixel driving circuit 100 may be input to a corresponding light-emitting element L in a form of a driving current, thereby driving the light-emitting element L to emit light. For example, the first display control sub-circuit 120_1 in the pixel driving circuit 100 outputs a driving signal based on the data signal, and provides the driving signal to the anode of the first light-emitting element L_1 that emits red light. The second display control sub-circuit 120_2 in the pixel driving circuit 100 outputs a driving signal based on the data signal, and provides the driving signal to the anode of the second light-emitting element L_2 that emits green light. The third display control sub-circuit 120_3 in the pixel driving circuit 100 outputs a driving signal based on the data signal, and provides the driving signal to the anode of the third light-emitting element L_3 that emits blue light. In this way, each pixel driving circuit 100 is able to drive a pixel including three sub-pixels of red, green and blue on the display panel.

In FIG. 6B, light-emitting elements L in the first row circulate in an order of the first light-emitting element L_1 that emits red light, the second light-emitting element L_2 that emits green light, and the third light-emitting element L_3 that emits blue light. Light-emitting elements in the second row circulate in an order of the second light-emitting element L_2 that emits green light, the third light-emitting element L_3 that emits blue light, and the first light-emitting element L_1 that emits red light, and so on. However, the embodiments of the present disclosure are not limited thereto, and the type, number and arrangement of the light-emitting elements L may be set as needed. For example, for RGBW pixels, each pixel may include the first light-emitting element L_1 that emits red light, the second light-emitting element L_2 that emits green light, the third light-emitting element L_3 that emits blue light, and a fourth light-emitting element that emits white light. In this case, the pixel driving circuit includes four display control sub-circuits. The first display control sub-circuit is connected to the first light-emitting element L_1, the second display control sub-circuit is connected to the second light-emitting element L_2, the third display control sub-circuit is connected to the third light-emitting element L_3, and the fourth display control sub-circuit is connected to the fourth light-emitting element.

Figure 7:
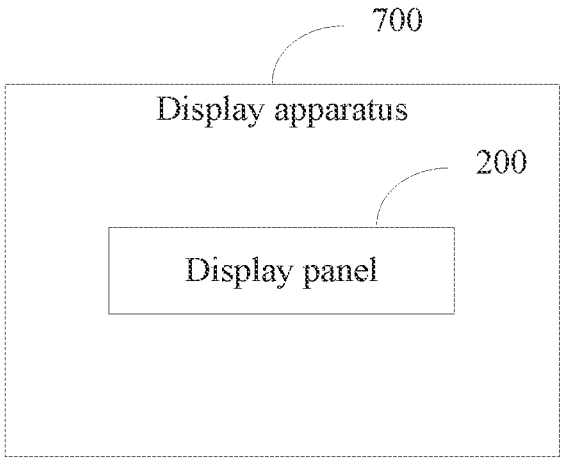
FIG. 7 shows a block diagram of a display apparatus, in accordance with embodiments of the present disclosure.
Figure 8:
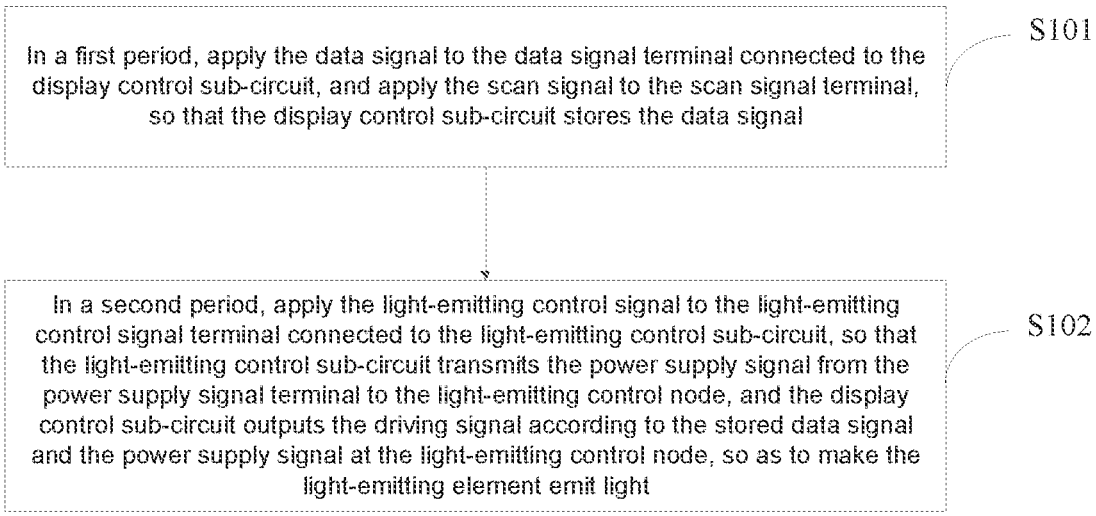
FIG. 8 shows a flow chart of a driving method of a pixel driving circuit, in accordance with embodiments of the present disclosure.

Embodiments of the present disclosure provide a display apparatus. As shown in FIG. 7, the display apparatus 700 includes a display panel 200. The display panel 200 may be implemented by the display panel in any one of the above embodiments. An example of the display apparatus 700 includes, but is not limited to, a display device with a display function, such as a display screen, a mobile phone, a television, a tablet computer, a notebook computer, or a desktop computer.

In some embodiments, the display apparatus 700 further includes a control circuit for controlling the display panel 200. For example, the control circuit includes, but is not limited to, a gate driver, a source driver, a timing controller, which will not be repeated here.

Some embodiments of the present disclosure further provide a driving method of a pixel driving circuit. The driving method includes S101 and S102, and may be applied to the pixel driving circuit in any one of the above embodiments.

In S101, in a first period, the data signal is applied to the data signal terminal connected to the display control sub-circuit, and the scan signal is applied to the scan signal terminal, so that the display control sub-circuit stores the data signal.

In S102, in a second period, the light-emitting control signal is applied to the light-emitting control signal terminal connected to the light-emitting control sub-circuit, so that the light-emitting control sub-circuit transmits the power supply signal from the power supply signal terminal to the light-emitting control node, and the display control sub-circuit outputs the driving signal according to the stored data signal and the power supply signal at the light-emitting control node, so as to make the light-emitting element emit light.

In the embodiments of the present disclosure, by connecting the plurality of display control sub-circuits to the light-emitting control sub-circuit, it is not required to provide a corresponding light-emitting control sub-circuit for each light-emitting element. On one hand, the number of transistors in the display panel is reduced, thereby simplifying the structure of the pixel driving circuit, and on another hand, wirings in the display panel are reduced, thereby reducing the shielding of a light-transmitting region of the display panel, and improving the aperture ratio of the pixel.

The embodiments of the present disclosure may be aimed at different types of display control sub-circuits, and have a wide application range and strong compatibility. In the embodiments of the present disclosure, the number of display control sub-circuits connected to the light-emitting control sub-circuit may be flexibly selected as needed, thereby realizing different levels of circuit simplification. For example, in one pixel, by connecting three display control sub-circuits for respectively controlling three red, green and blue light-emitting elements to the light-emitting control sub-circuit, the balance between the circuit stability and the circuit configuration simplification is able to be realized.

Those skilled in the art may understand that the embodiments described above are exemplary, and may be modified by those skilled in the art. The structures described in the various embodiments may be freely combined without conflict in structure or principle.

After the preferred embodiments of the present disclosure are described in detail, those skilled in the art may understand clearly that, various changes and modifications may be made without departing from the scope and spirit of the appended claims, and the disclosure is not limited to the implementation manners of the exemplary embodiments listed in the description.

What is claimed is:

1. A pixel driving circuit, comprising:

a light-emitting control sub-circuit connected to a light-emitting control signal terminal, a power supply signal terminal and a light-emitting control node; the light-emitting control sub-circuit being configured to transmit a power supply signal from the power supply signal terminal to the light-emitting control node in response to a light-emitting control signal received from the light-emitting control signal terminal; and a plurality of display control sub-circuits, each display control sub-circuit being connected to the light-emitting control node, a scan signal terminal, a data signal terminal, and a light-emitting element; the display control sub-circuit being configured to, in response to a scan signal received from the scan signal terminal, output a driving signal according to the power supply signal from the power supply signal terminal at the light-emitting control node and a data signal from the data signal terminal, so as to drive the light-emitting element to emit light, wherein the light-emitting control sub-circuit includes a first transistor, a gate of the first transistor is connected to the light-emitting control signal terminal, a first electrode of the first transistor is connected to the power supply signal terminal, and a second electrode of the first transistor is connected to the light-emitting control node, wherein the display control sub-circuit includes: a first control sub-circuit connected to the scan signal terminal, the data signal terminal and a first driving sub-circuit; the first control sub-circuit being configured to transmit the data signal from the data signal terminal to the first driving sub-circuit in response to the scan signal received from the scan signal terminal; and the first driving sub-circuit further connected to the light-emitting control node and the light-emitting element; the first driving sub-circuit being configured to output the driving signal according to the power supply signal from the power supply signal terminal at the light-emitting control node and the data signal from the data signal terminal, so as to drive the light-emitting element to emit light, wherein the first control sub-circuit includes a second transistor, and the first driving sub-circuit includes a third transistor and a first capacitor, and the third transistor is a driving transistor, wherein a gate of the second transistor is connected to the scan signal terminal, a first electrode of the second transistor is connected to the data signal terminal, a second electrode of the second transistor is connected to a gate of the third transistor, wherein a first electrode of the third transistor is connected to the light-emitting control node, a second electrode of the third transistor is connected to the light-emitting element, and wherein a first terminal of the first capacitor is connected to the gate of the third transistor, a second terminal of the first capacitor is directly connected to the second electrode of the third transistor, and wherein the display control sub-circuit further includes a second control sub-circuit connected to a first signal terminal, a second signal terminal and the second electrode of the third transistor, the second control sub-circuit being configured to, in response to a control signal received from the first signal terminal, transmit a reset signal from the second signal terminal to the second electrode of the third transistor, so as to reset the light-emitting element connected to the second electrode of the third transistor, and output a parameter of the third transistor through the second signal terminal;

wherein the second control sub-circuit includes a fourth transistor, a gate of the fourth transistor is connected to the first signal terminal, a first electrode of the fourth transistor is connected to the second signal terminal, and a second electrode of the fourth transistor is connected to the second electrode of the third transistor;

a channel width-to-length ratio of the third transistor is greater than a channel width-to-length ratio of the first transistor, a channel width-to-length ratio of the second transistor, and a channel width-to-length ratio of the fourth transistor;

the first transistor, the second transistor, the third transistor and the fourth transistor are N-type transistors;

the scan signal terminal is configured to output a high level in a reset phase, a compensation phase and a data writing phase, and output a low level in a transition phase and a light-emitting phase;

the first signal terminal is configured to output a high level in the reset phase, and output a low level in the compensation phase, the transition phase, the data writing phase and the light-emitting phase;

the light-emitting control signal terminal is configured to output a high level in the reset phase and the compensation phase, output a low level in the transition phase and the data writing phase, and output a low level first, then output a high level after a preset time in the light-emitting phase;

the data signal terminal is configured to output a high level in the reset phase, the compensation phase and the data writing phase, and output a low level in the transition phase and the light-emitting phase.

2. A display panel having a plurality of sub-pixel regions, the display panel comprising:

a plurality of pixel driving circuits according to claim 1; and a plurality of light-emitting elements, each light-emitting element being connected to a corresponding display control sub-circuit, and the light-emitting element and the corresponding display control sub-circuit being located in a same sub-pixel region;

wherein light-emitting control signal terminals connected to light-emitting control sub-circuits located in sub-pixel regions in a same row are connected to one another, scan signal terminals connected to display control sub-circuits located in sub-pixel regions in a same row are connected to one another, and data signal terminals connected to display control sub-circuits located in sub-pixel regions in a same column are connected to one another;

the plurality of display control sub-circuits in each pixel driving circuit are located in respective sub-pixel regions in a same row;

the plurality of display control sub-circuit include three display control sub-circuits, and the three display control sub-circuits include a first display control sub-circuit, a second display control sub-circuit, and a third display control sub-circuit; the plurality of light-emitting elements include first light-emitting elements that emit red light, second light-emitting elements that emit green light, and third light-emitting elements that emit blue light; the first display control sub-circuit is connected to one of the first light-emitting elements, the second display control sub-circuit is connected to one of the second light-emitting elements, and the third display control sub-circuit is connected to one of the third light-emitting elements.

3. A display apparatus, comprising the display panel according to claim 2.

4. A driving method of the pixel driving circuit according to claim 1, comprising:

in a first period, applying the data signal to the data signal terminal connected to the display control sub-circuit, and applying the scan signal to the scan signal terminal, so that the display control sub-circuit stores the data signal; and in a second period, applying the light-emitting control signal to the light-emitting control signal terminal connected to the light-emitting control sub-circuit, so that the light-emitting control sub-circuit transmits the power supply signal from the power supply signal terminal to the light-emitting control node, and the display control sub-circuit outputs the driving signal according to the stored data signal and the power supply signal at the light-emitting control node, so as to make the light-emitting element emit light.

* * * * *